US006189506B1

(12) United States Patent
Vanderveen

(10) Patent No.: US 6,189,506 B1
(45) Date of Patent: Feb. 20, 2001

(54) THROTTLE SHAFT ROTATION LIMITING DEVICE

(75) Inventor: James Vanderveen, Blenheim (CA)

(73) Assignee: Siemens Canada Limited, Ontario (CA)

( * ) Notice: Under 35 U.S.C. 154(b), the term of this patent shall be extended for 0 days.

(21) Appl. No.: 09/369,807

(22) Filed: Aug. 6, 1999

(51) Int. Cl.[7] ..... F02D 9/10
(52) U.S. Cl. ..... 123/337; 123/339.13; 251/307
(58) Field of Search ..... 123/337, 339.13; 251/305, 307

(56) References Cited

U.S. PATENT DOCUMENTS

| | | | | |
|---|---|---|---|---|
| 2,190,738 | * | 2/1940 | Schweiss | 123/339.13 |
| 3,269,713 | * | 8/1966 | Beck | 123/339.13 |
| 4,086,900 | * | 5/1978 | Marsh | 123/337 |
| 4,161,298 | * | 7/1979 | Teague et al. | 123/339.13 |
| 5,979,871 | * | 11/1999 | Forbes et al. | 123/337 |
| 6,065,483 | * | 5/2000 | Tanaka et al. | 123/337 |

FOREIGN PATENT DOCUMENTS

| | | | | |
|---|---|---|---|---|
| 52-40234 | * | 3/1977 | (JP) | 123/339.13 |
| 57-105533 | * | 7/1982 | (JP) | 123/339.13 |
| 58-47144 | * | 3/1983 | (JP) | 123/339.13 |

* cited by examiner

*Primary Examiner*—Erick Solis

(57) ABSTRACT

A throttle valve for throttling the combustion air flow for an internal combustion engine is disclosed, having a body with a throat, a butterfly in the throat to throttle flow, and a shaft connected to the butterfly to operate it. The shaft has an arm that abuts a throttle stop to maintain the butterfly in an almost-closed (or idle) position. The arm has an opening that permits access to the head of the throttle stop to adjust the throttle stop when the throttle valve is in the almost-closed position. The opening is located so that a tool such as a hex wrench can pass through the opening and engage a socket in the head of the throttle stop, pemitting it to be rotated and adjusted. The throttle shaft and arm are preferably integrally molded of plastic, and the throttle stop head is preferably larger than the threaded shaft of the throttle stop.

20 Claims, 2 Drawing Sheets

THROTTLE SHAFT ROTATION LIMITING DEVICE

FIELD OF THE INVENTION

The present invention relates generally to combustion air induction systems for internal combustion automotive engines. More particularly, it relates to methods and devices for adjusting throttle plate position of a combustion air throttle valve.

BACKGROUND OF THE INVENTION

Internal combustion engines are often provided with a throttle valve within their combustion air induction systems to control combustion airflow rate. The throttle valve is typically in the form of a butterfly valve, having a disk secured to a throttle shaft which is journaled to the generally cylindrical internal wall surface of a throat of a throttle body. The diameter of the disk is only slightly smaller than is the inside diameter of the throat, whereby the throttle plate may block all but a small portion of the air from passing through the throat in an idle condition. Typically, a return spring is used to bias the throttle shaft and butterfly closed with respect to the throat, shutting off almost all the airflow past through the throttle valve.

Provisions are made for adjusting the throttle valve to compensate for variations between particular engines, differences in their operating environments, gradual changes in characteristics due to wear, etc.

Adjusting the almost-closed position of the throttle valve is generally performed by rotating an adjusting screw that abuts the throttle arm. The throttle arm is affixed to the throttle shaft, and is disposed to approach a fixed surface of the engine when closed. The adjusting screw is typically screwed into either the arm or the fixed surface, and abuts the other. By rotating the adjusting screw, the almost-closed position of the throttle valve can be precisely regulated.

While a long thread engagement is not needed in such a low-force application, engagement of at least several threads is desirable to avert cross-threading and stripping of threads. This has necessitated the arm being constructed of metal having a thickness sufficient to accommodate the several threads when the adjusting screw is threaded into the arm.

Alternatively, it is known to threadedly engage an idle adjusting screw with a threaded aperture in a fixed surface disposed such that the end of the screw abuts the arm (U.S. Pat. No. 3,269,713, Beck, 1966; U.S. Pat. No. 4,161,928, Teague et al., 1979; U.S. Pat. No. 4,200,596, Iiyama et al., 1980; U.S. Pat. No. 4,502,436, Bonfiglioli et al., 1985; and U.S. Pat. No. 4,940,031, Mann, 1990). All such idle adjusting screws have a feature to enable rotation (e.g., a head having a screwdriver slot) located at the free end; i.e. the end not abutting the arm. In some configurations, and particularly in engine installations wherein there are many surfaces and pieces of auxiliary equipment near the engine, it is difficult to access such an adjusting screw.

It would be advantageous to provide for an engine throttle idle adjusting screw which is threadedly engaged with a fixed surface, abuts an arm of a throttle shaft for limiting rotation of the throttle shaft and thereby of a throttle plate, and is rotatably adjustable from the abutting end.

SUMMARY OF THE PRESENT INVENTION

An aspect of the present invention pertains to a combustion air throttle for an internal combustion engine, the engine operable at an idle speed, the throttle including a throttle body having a throat, a valving member movably disposed within the throat for throttling flow of combustion air and having an idle position corresponding to the idle speed; a throttle shaft projecting outside the throat, coupled to the valving member, and having a radially extending arm, wherein the arm includes an opening; and an idle speed throttle stop threadedly engaged with an aperture within a fixed surface of the throttle, having an end adjustably positioned and disposed to abut the arm in the idle position and thereby adapted to adjust the idle speed of the engine, and wherein a central portion of the end of the throttle stop which abuts the arm includes an engagement feature which is configured for engagement with an adjusting tool and is disposed within the opening when the arm is in the idle position; the opening thereby providing access for the adjusting tool through the arm to the throttle stop.

Another aspect of the present invention pertains to a method of adjusting an idle speed of an engine at a throttle, the method including the steps of operating the engine at an idle speed; inserting a throttle stop adjusting tool through an opening within an arm of a rotatable throttle shaft, the throttle shaft coupled to a valving member of the throttle, the arm abutting a throttle stop when the engine is operating at idle speed, the throttle stop threadedly engaged with a fixed surface and located in alignment with the opening of the arm; and engaging and rotating the throttle stop to adjust the idle position of the arm and thereby of the throttle shaft and of the valving member.

BRIEF DESCRIPTION OF THE DRAWINGS

A full understanding of the invention may be gained from the Drawings taken in conjunction with the Detailed Description below, wherein like reference numerals refer to like parts.

DETAILED DESCRIPTION OF THE PREFERRED EMBODIMENTS

Figure 1:
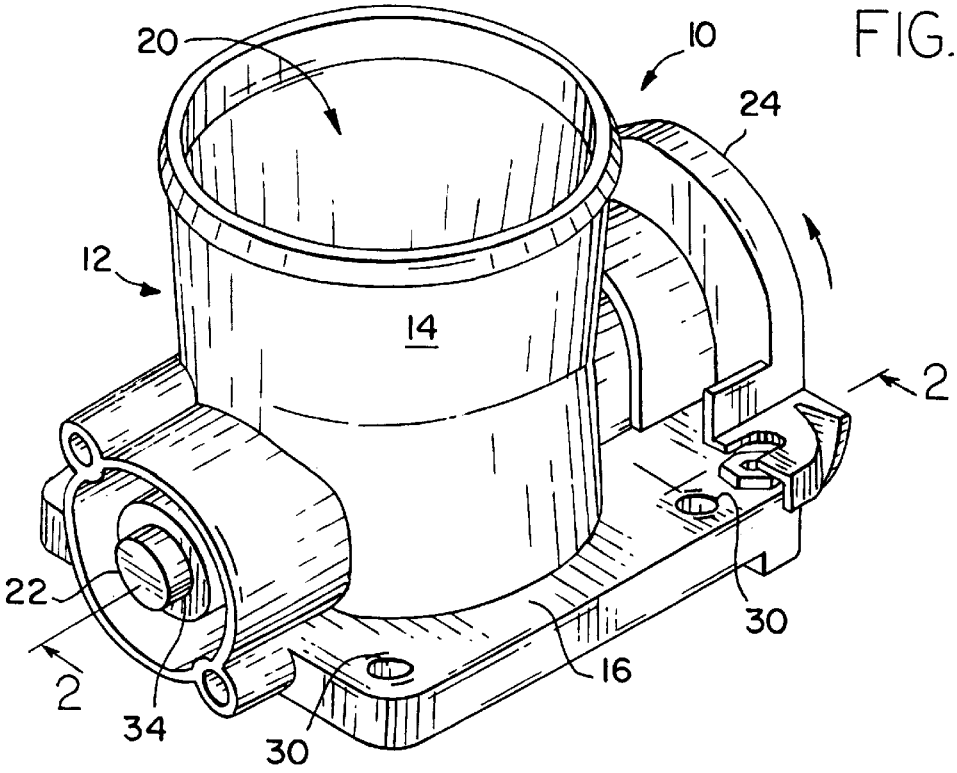
FIG. 1 is a perspective view of a throttle valve having a throttle stop threadedly engaged with a base of the throttle valve.

FIG. 1 is a perspective view showing a throttle valve 10 including a throttle body 12 having a throat 14 and a base 16. Throttle valve 10 further includes a valving member (or butterfly) 18 (shown in FIG. 2) movably disposed within throat 20, a shaft 22 rotatably movable with respect to throat 20 and coupled to valving member 18 to effect its movement from an open to a closed position and vice versa, and an arm 24 affixed to shaft 22. Throttle valve 10 further includes a throttle stop 26 which is secured to body 12.

In a preferred embodiment, throat 14 is generally circular in cross-section as shown, but may be of another shape in an alternative embodiment. Base 16 is provided a generally flat bottom surface 28 (shown in FIG. 2) and apertures 30, which are typically provided for mounting the throttle valve to a surface of an engine (not shown); e.g., a combustion air intake manifold.

Figure 2:
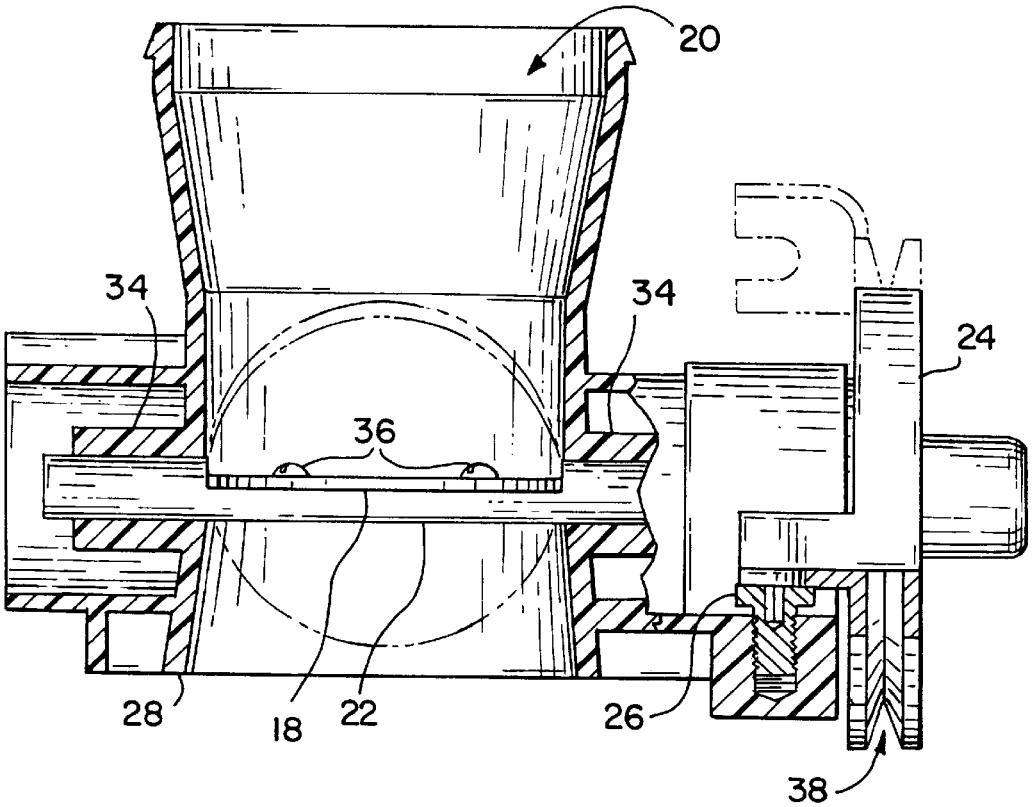
FIG. 2 is a sectional elevation of the throttle valve taken at section 2—2 of FIG. 1.

FIG. 2 is a sectional elevation of throttle valve 10, showing shaft 22 extending transversely through throat 20 and journaled to apertures in bosses 34 of body 12. Valving member 18 is affixed to shaft 22 so that it is rotated by shaft 22 between substantially open and closed positions, in the manner of a butterfly valve.

In a preferred embodiment, body 12 is molded of a polymer. In a particularly preferred embodiment, body 12, arm 24, shaft 22, and valving member 18 are molded, or otherwise fashioned, of polymers. Advantages to this construction include light weight, high oxidation resistance, and low manufacturing cost.

In a preferred embodiment, shaft 22 includes at least one boss 36 (and preferably two or more) projecting from a surface of shaft 22. Boss 36 is preferably longer than the thickness of valving member 18. Valving member 18 preferably includes at least one aperture configured to receive boss 36. Valving member 18 is fixed to shaft 22 by placing valving member 18 upon shaft 22 with bosses 36 projecting through the apertures, heating the free end of bosses 36 to a forming temperature, and forming the free end of bosses 36 over the adjacent surface of valve member 18 in the manner of a rivet head.

In alternative embodiments (not shown), a shaft may be provided with a slot configured to receive a valving member inserted edge-wise into the slot; a valving member may be secured to the shaft by one or more fasteners (e.g., machine screws or rivets); or a valving member may be molded integrally with a shaft. In an alternative embodiment, valving member 18 may be molded integral with body 12 within throat 20 and connected to it by conventional breakaway tabs (not shown).

In any preferred embodiment, shaft 22 extends beyond one of bosses 36 (shown on the right side of FIG. 2) and is coupled to arm 24. Arm 24 is shown including a pulley portion 38 which is configured to be engaged by a throttle cable (not shown), movement of which rotates arm 24 and shaft 22, thereby changing the angle of disposition of valving member 18 within throat 20, and thereby changing the amount of open area available for flow, or flow area, of throttle valve 10. In alternative embodiments, shaft 22 may be rotated by other devices; e.g., a torsional cable, a lever, a rotary or linear actuator, etc.

Throttle stop 26 is configured as a threaded member (e.g., a machine screw) threadedly engaged with a cavity formed within throttle body 12, preferably in base 16. In FIG. 2, arm 24 is shown abutting an end of throttle stop 26 when valving member 18 is substantially closed. In a preferred embodiment, throttle stop 26 is an idle speed adjusting screw and throttle valve 10 is configured to bias arm 24 against throttle stop 26 (e.g., by a return spring, not shown) so that the engine defaults to a closed or idle condition. Arm 24 is provided with an opening (or aperture) shown as an open-ended slot 40A in FIG. 1–3 and as a hole 40B in FIG. 6. In this manner arm 24 abuts the relatively large surface area of the head of stop 26, thus distributing the closing impact more evenly. This reduces wear on arm 24 where it abuts stop 26 and also reduces the chance of arm breakage. These are particular concerns in throttle valves with plastic arms.

Figure 3:
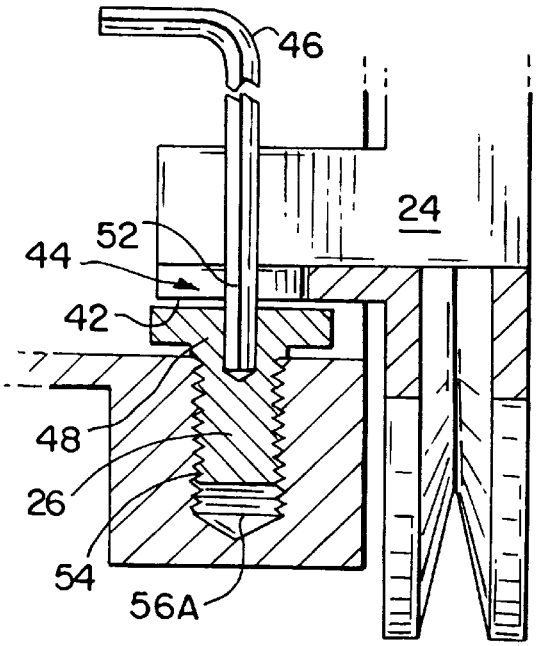
FIG. 3 is a fragmentary section of a throttle stop adjusting tool engaging the throttle stop of the throttle valve of FIGS. 1–2 through an opening or aperture in the throttle shaft arm, wherein the throttle stop is threadedly engaged with the material of the base.

FIG. 3 is a fragmentary sectional detail showing arm 24 having a surface 42 abutting throttle stop 26 when valving member 18 is in a substantially closed position with respect to throat 20, thereby causing the engine to operate at idle speed. Opening 44 in arm 24 provides access for an adjusting tool 46 (shown here as a key wrench) to engage head 48 of throttle stop 26, head 48 including surfaces (shown as a recess 50) configured to engage tool 46. Opening 44 is shown as an elongate recess extending inward from a free edge of the throttle arm. Opening 44 defines throttle stop engaging surfaces that extend about the abutting surfaces of throttle stop 26. A shaft portion 52 of tool 46 passes through opening 44 to engage recess 50. Throttle stop 26 is threadedly engaged with threads 54 tapped, or otherwise formed, directly within the material of base 16 in a cavity 56A. In a preferred embodiment, cavity 56A is configured as a blind hole and throttle stop 26 is constructed of a metal (e.g., a brass or a steel). In a particularly preferred embodiment, threads 58 of throttle stop 26 are configured as self-tapping threads and cavity 56A therefore need not be pre-tapped in manufacturing.

Opening 44 of arm 24 provides access for tool 46 to engage recess 50, the configuration and location of opening 44 being in predetermined correspondence with recess 50 in substantially all idle positions of throttle stop 26. Rotation of tool 46 within recess 50 and with respect to throttle valve 10 rotates throttle stop 26, and the pitch of threads 58 causes head 48 of throttle stop 26 to change its longitudinal position with respect to base 16 and thereby change the abutting position of arm 24. The idle position of valving member 18 (shown in FIG. 2) is thereby changed, and hence the minimum flow area of throttle valve 10, and thereby the idle speed of the engine, are changed correspondingly.

Figure 4:
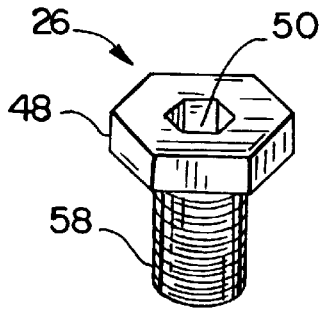
FIG. 4 is a perspective view of the throttle stop of FIGS. 1–3.

FIG. 4 shows a preferred embodiment of throttle stop 26. Throttle stop 26 is generally configured as a machine screw having threads 58 and head 48, head 48 preferably including a conventional hexagonal recess 50 centrally located within head 48, recess 50 configured to receive a tool 46 (shown in FIGS. 3 and 5) configured as a conventional hexagonal key wrench. In alternative embodiments, a recess may be configured to receive a tool configured as a square key wrench, Torks8 key wrench, cross-slot or straight-slot screwdriver, etc. In other alternative embodiments, the tool engaging feature of head 48 may be a projection configured to engage a tool configured as a nut driver.

In a particularly preferred embodiment, head 48 is also provided with flats upon its sides configured for engagement by a wrench. This facilitates automated installation of throttle stop 26 to body 12 (shown in FIGS. 1 and 2) during manufacturing by permitting use of a nut driver. It also provides a worker another means of access for adjusting the position of throttle stop 26, by allowing throttle stop 26 to be accessed from the side using an open-end wrench or a pair of pliers, for example.

Figure 5:
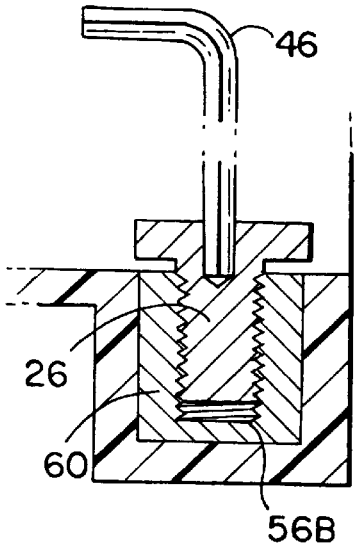
FIG. 5 is a fragmentary section of the throttle stop adjusting tool engaging another embodiment of the throttle stop threadedly engaged with a threaded insert affixed to the base.

FIG. 5 is a fragmentary sectional detail of an alternative embodiment of base 16, in which a threaded insert 60 is affixed to a cavity 56B (e.g., by ultrasonic or spin welding) formed within base 16. Insert 60 is preferably constructed of metal (e.g., bronze brass, or steel). Insert 60 may be configured to retain throttle stop 26 in an adjusted position by thread locking means (not shown); e.g., a polymer patch or plug, a frictional coating or deformation to a slightly oval cross sectional shape. Alternatively, stop 26 may have such a thread locking means.

Figure 6:
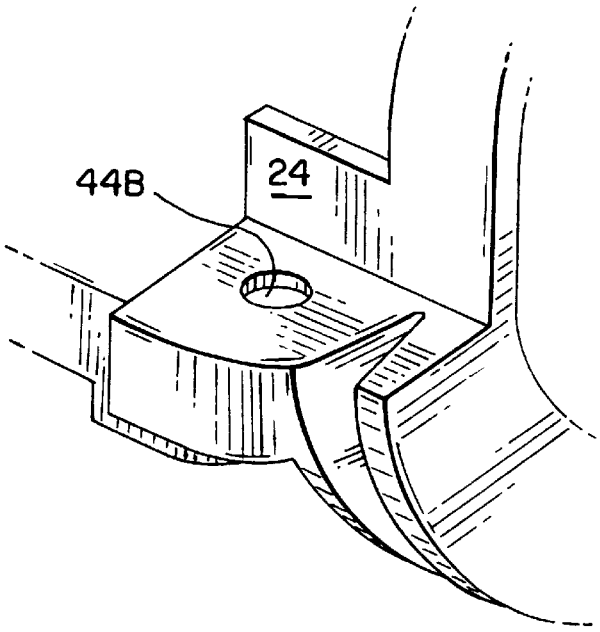
FIG. 6 is a fragmentary perspective view of another embodiment of the aperture in the throttle shaft arm.

FIG. 6 is a fragmentary perspective view of an alternative embodiment of arm 24, in which opening 44 of arm 24 is configured as a hole 44B. This provides more contact area between arm 24 and head 48 (shown in FIGS. 1–3 and 5) and makes the abutting surface of arm 24 stronger, but requires greater accuracy and repeatability of location of arm 24 with respect to throttle stop 26 (shown in FIGS. 1–3 and 5) in manufacturing assembly in order to maintain alignment of hole 44B with recess 50 in head 48.

While the embodiments illustrated in the Figures and described above are presently preferred, is should be understood that these embodiments are offered only as examples. Variations of construction rather than invention will be obvious to those skilled in the art, but are nonetheless within the scope and spirit of the present invention. The invention is not limited to any particular embodiment, but is intended to encompass various modifications and differences of construction that fall within the scope and spirit of the claims.

What is claimed is:

1. A combustion air throttle valve for an internal combustion engine of a vehicle, the engine operable at an idle speed when the throttle valve is in a substantially closed position, the throttle valve comprising:

a throttle body having a throat;

a valving member movably disposed within the throat for throttling flow of combustion air and having an idle position corresponding to the idle speed;

a throttle shaft projecting outside the throat, coupled to the valving member, and having a radially extending arm, wherein the arm includes an opening; and a throttle stop threadedly engaged with an aperture in a fixed surface of the throttle body, and having an end adjustably positioned and disposed to abut the arm in the substantially closed position, and wherein the throttle stop includes an engagement surface which is configured for engagement and rotation with an adjusting tool disposed within the opening when the arm is in the substantially closed position.

2. The throttle valve of claim 1, wherein the valving member is a throttle plate.

3. The throttle valve of claim 1, wherein the shaft is affixed to at least one of the arm and the valving member.

4. The throttle valve of claim 1, wherein the shaft is constructed integral with at least one of the arm and valving member.

5. The throttle valve of claim 1, wherein at least one of the shaft, the arm, and the valving member is constructed of a polymer.

6. The throttle valve of claim 3, wherein the shaft and at least one of the arm and the valving member are constructed of at least one polymer.

7. The throttle valve of claim 1, wherein the engagement feature is a recess configured to receive a screwdriver and the adjusting tool is a screwdriver.

8. The throttle valve of claim 1, wherein the engagement feature is a recess configured to receive a key wrench and the adjusting tool is a key wrench.

9. The throttle valve of claim 1, wherein the engagement feature is a boss configured to be engaged by a nut driver and the adjusting tool is a nut driver.

10. The throttle valve of claim 1, wherein the throttle stop has a longitudinal rotational axis and the abutting surface of the arm is configured to be substantially perpendicular to the longitudinal rotational axis of the throttle stop in at least one position in which the arm abuts the throttle stop.

11. The throttle valve of claim 1, wherein the opening is generally circular.

12. The throttle valve of claim 1, wherein the opening is generally elongate.

13. The throttle valve of claim 12, wherein the opening is a recess extending inward from a free surface of the arm.

14. The throttle valve of claim 1, wherein the abutting end of the throttle stop includes a head having an abutting end sides, wherein the engagement surface recess is disposed within the abutting end of the head, and wherein the outwardly facing sides of the head include surfaces configured for engagement by a second tool.

15. The throttle valve of claim 14, wherein the second tool engagement surfaces include wrenching flats.

16. A combustion air throttle valve for an internal combustion engine, comprising:

a molded plastic throttle body;

a molded plastic valving member disposed within the throat for throttling the flow of combustion air;

a plastic throttle shaft extending into the throat and coupled to the valving member, and having an integrally molded and radially extending arm having an opening; and a throttle stop threadedly engaged with the throttle body, and having a threaded shaft with an abutting end with a tool engaging recess disposed to abut the arm proximate to the opening.

17. The throttle valve of claim 16, wherein the abutting end is larger than the threaded shaft and wherein the opening extends about the tool engaging recess.

18. The throttle valve of claim 17, wherein the abutting end has wrench engaging flats disposed about its periphery.

19. The throttle valve of claim 17, wherein the arm has an abutting surface disposed to abut the abutting end, and further wherein the abutting surface is generally perpendicular to the abutting end when the abutting surface abuts the abutting end.

20. A method of adjusting an idle speed of an engine at a throttle, the method comprising the steps of: operating the engine at an idle speed; inserting a throttle stop adjusting tool through an opening within an arm of a rotatable throttle shaft, the throttle shaft coupled to a valving member of the throttle, the arm abutting a throttle stop when the engine is operating at idle speed, the throttle stop threadedly engaged with a fixed surface and located in alignment with the opening of the arm; and engaging and rotating the throttle stop to adjust the idle position of the arm and thereby of the throttle shaft and of the valving member.

* * * * *